US005516307A

United States Patent [19]

Cartesse et al.

[11] Patent Number: 5,516,307

[45] Date of Patent: May 14, 1996

[54] ANGLED COAXIAL CONNECTOR ELEMENT ABLE TO BE FIXED TO A PRINTED CARD

[75] Inventors: Georges Cartesse, Le Blanc Mesnil; Jacky Bouleau, Villeparisis, both of France

[73] Assignee: Radiall, Rosny-Sous-Bois, France

[21] Appl. No.: 201,111

[22] Filed: Feb. 24, 1994

[30] Foreign Application Priority Data

Feb. 26, 1993 [FR] France ..... 93 02244

[51] Int. Cl.[6] ..... H01R 17/04

[52] U.S. Cl. ..... 439/581; 439/63

[58] Field of Search ..... 439/79, 582, 63, 439/579, 676, 858, 578, 580, 581, 583–585

[56] References Cited

U.S. PATENT DOCUMENTS

| | | | |
|---|---|---|---|
| 4,836,791 | 6/1989 | Grabbe et al. | 439/79 |
| 4,861,271 | 8/1989 | Bogar et al. | 439/63 |
| 4,892,491 | 1/1990 | Budano, II et al. | 439/582 |
| 4,915,655 | 4/1990 | Tanaka | 439/676 |
| 4,917,616 | 4/1990 | Demier, Jr. et al. | 439/579 |
| 5,060,373 | 10/1991 | Machura et al. | 29/858 |
| 5,090,912 | 2/1992 | Zell | 439/79 |
| 5,344,340 | 9/1994 | Bouleau | 439/63 |

*Primary Examiner*—David L. Pirlot
*Assistant Examiner*—Jill DeMello
*Attorney, Agent, or Firm*—Schweitzer Cornman & Gross

[57] ABSTRACT

The invention relates to an angled coaxial connector element of the type including a substantially parallelepipedal conductor body, at least one angled conducting stalk, one end of which is linked to a pin projecting from one of the faces of the said body and the other end of which is linked to the central conductor of a coaxial contact, projecting from another face of the said body and perpendicular to the pin, the angled conducting stalk being held by an insulant within an internal L-shaped conduit produced in the body.

The said insulant (18, 19) has a narrowing in cross-section defining a layer of air (18', 19') around at least a part of the straight-line branch of the said stalk (8, 9).

6 Claims, 3 Drawing Sheets

ANGLED COAXIAL CONNECTOR ELEMENT ABLE TO BE FIXED TO A PRINTED CARD

BACKGROUND OF THE INVENTION

The present invention relates to an angled coaxial connector element able to be fixed to a printed card.

Coaxial connectors are already known making it possible to link electrically two printed cards arranged perpendicularly with respect to one another.

The applicant has already described such a coaxial connector in FR-A-2,685,553.

This connector includes a straight element as well as an angled element, which is equipped, on one of its faces, with pins for connecting it to a first printed card and, on a face perpendicular to the first one, with coaxial contacts able to interact with coaxial contacts of the straight element which is connected to a second printed card arranged perpendicularly to the first printed card.

The angled element is, in general, connected to the first printed card by plugging-in and lead-tin soldering of its pins in corresponding orifices produced on the said card.

In certain cases, the angled element includes, as pins, contacts which can be inserted by force.

These contacts include an elastic central part which has an outer cross-section greater than the passage cross-section of the orifices provided on the card.

The mounting on the printed card of a connector element equipped with contacts which can be inserted by force takes place by exerting a significant force (of the order of 30 to 100 Newtons) by contact on its face opposite to the card, in such a way as to force the contacts within the orifices.

Once fixed to the printed card, the connector element has good mechanical properties.

In practice, however, an inadequacy is noted in terms of the electrical transmission properties, due to a certain mismatching of impedance.

SUMMARY OF THE PRESENT INVENTION

The present invention aims to supply an angled coaxial connector element particularly avoiding this drawback.

The subject of the present invention is an angled coaxial connector element of the type including a substantially parallelepipedal conductor body, at least one angled conducting stalk, one end of which is linked to a pin projecting from one of the faces of the said body and the other end of which is linked to the central conductor of a coaxial contact, projecting from another face of the said body and perpendicular to the pin, the angled conducting stalk being held by an insulant within an internal L-shaped conduit produced in the body, characterized in that the said insulant has a narrowing in cross-section defining a layer of air around at least a part of the straight-line branch of the said stalk.

This narrowing of cross-section makes it possible to form an annular space filled with air around at least a part of the straight-line branches of the insulant, which allows the impedance of the electrical line constituted by the angled conducting stalk to be adjusted to suit.

Preferably, the insulant includes, in the vicinity of the angled part of the angled conducting stalk, surfaces bearing against the inner wall of the internal L-shaped conduit.

Advantageously, the insulant also includes, at the ends of the angled conducting stalk, surfaces bearing, on the one hand, against the inner wall of the internal L-shaped conduit, on the other hand, against the inner wall of the outer sleeve of the coaxial contact.

By virtue of such an insulant, a pressure can be exerted on the connector element without damaging it, the force resulting from this pressure being exerted through the wall of the body of the connector element, on the angled conducting stalk, which transmits this effort to the projecting pins penetrating into the orifices provided to this effect on the printed card.

Hence, it is possible to use contacts which can be inserted by force as pins allowing the angled connector element to be connected to the printed card.

In one preferred embodiment of the invention, the body of the angled coaxial connector element is produced in two parts fitting into one another, the main plane of separation of these two parts passing substantially through the axes of the two branches of the angled conducting stalk.

By virtue of such an arrangement, the angled conducting stalk equipped with its insulant can be easily inserted within the body of the connector element according to the invention, before assembly of the two parts of which it consists.

For the purposes of making the invention better understood, an embodiment will now be described thereof given by way of an example without any limiting nature, with reference to the attached drawing in which:

DETAILED DESCRIPTION OF THE INVENTION

Figure 1:
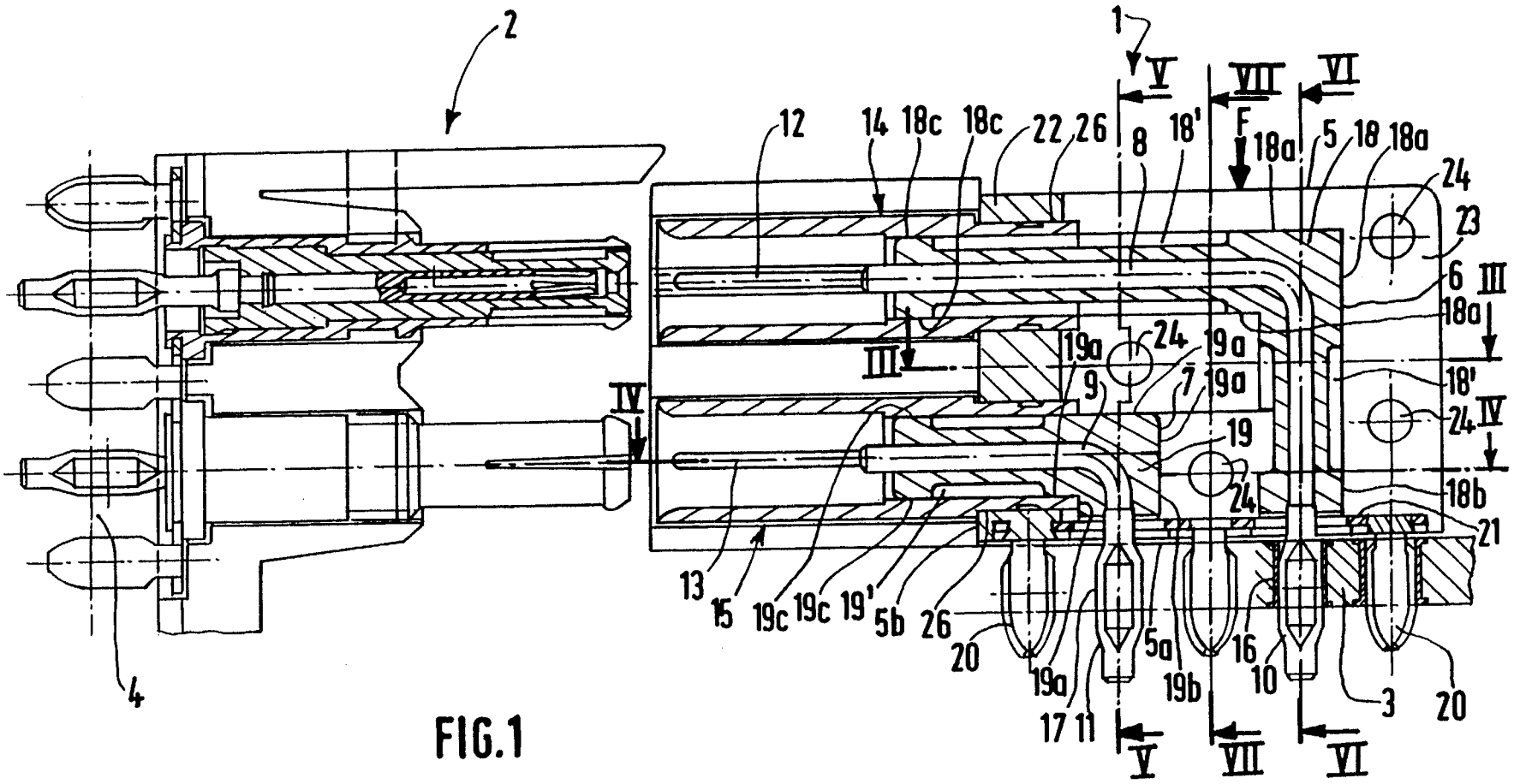
FIG. 1 is a view in partial section of a coaxial connector including an angled element according to the invention and a straight element.

In the drawing, a coaxial connector has been represented including an angled element, designated overall by 1, and a straight element, designated overall by 2.

In the embodiment represented, the angled element is mounted on a first printed card 3, called daughter board, and the straight element 2 is mounted on a second printed card 4, called mother board.

By bringing the two connector elements 1 and 2 axially together in their position represented in FIG. 1, the daughter board 3 is connected to the mother board 4.

The angled element 1 includes a body of substantially parallelepipedal shape 5, produced for preference in a metal material such as a light zinc-aluminium alloy, for example the alloy known by the name of Zamak which consists of 96% zinc and 4% aluminium.

The parallelepipedal body 5 internally includes two L-shaped conduits 6 and 7, which open out on two orthogonal faces **5*a* and 5*b* of the body 5**.

The axes of the two conduits 6 and 7 are situated in the same plane which is substantially a median plane of the body 5.

By lower face is meant the face 5*a*, and by front face the face 5*b*.

Two angled conducting stalks 8 and 9 are housed in the L-shaped conduits 6 and 7 and link contact pins 10, 11 projecting from the lower face 5*a* to central conductors 12, 13 of coaxial contacts 14, 15 projecting from the front face 5*b*.

The axes of the angled conducting stalks 8 and 9 are situated in the median plane containing the axes of the conduits 6 and 7.

In the embodiment represented, the contact pins 10 and 11 are of the type which can be inserted by force, that is to say that they are elastically deformable radially. Their cross-section exhibits dimensions which are slightly greater than those of orifices 16, 17, formed in the printed card 3, and into which the said contact pins 10, 11 are intended to be inserted.

Each orifice 16, 17 includes a metallization providing the electrical contact between the printed circuits of the card 3 and the contact pins 10, 11.

In accordance with the invention, each angled conducting stalk 8, 9 is fitted with an insulant 18, 19 which includes surfaces 18*a* and 19*a* bearing against the inner wall of the corresponding L-shaped conduit 6, 7, especially in the vicinity of the angled part of the said conducting stalk.

By virtue of the insulant 18, 19, it is possible to exert pressure on the body 5 in the direction indicated by the arrow F, in order to insert the contact pins 10, 11 by force into the metallized holes 16, 17.

The absence of play in the vicinity of the angles of the angled conducting stalks 8, 9 avoids any deformation of the parts making up the angled connector element 1, and, consequently, any damage to the parts.

According to the invention, in order to produce the insulant 18, 19, materials having good dielectric characteristics at high frequencies are used, for example a polyetherimide such as that known by the name of ULTEM, or a copolymer of ethylene and of monochlorotrifluoroethylene, such as that known by the name of HALAR.

In order to adjust appropriately, for example to 50 ohms, the impedance of the electrical line constituted by each angled conducting stalk 8, 9, it is advantageous to free a space around the insulant 18, 19 in such a way as to create an annular layer of air 18', 19' around at least a part of the straight-line branches of each stalk.

To this end, the insulants 18 and 19 include a narrowing of cross-section in their linear parts.

In contrast, at the extremities of the angled conducting stalks 8 and 9, the insulant includes surfaces 18*b*, 19*b*; 18*c*, 19*c* bearing, on the one hand, against the L-shaped conduit 6, 7 of the daughter board 3 side and, on the other hand, against the external sleeve of the coaxial contact 14, 15 on the mother board 4 side.

The angled element 1, in the example illustrated, includes six earth contact pins 20 also inserted by force into the printed card 3.

Figure 2:
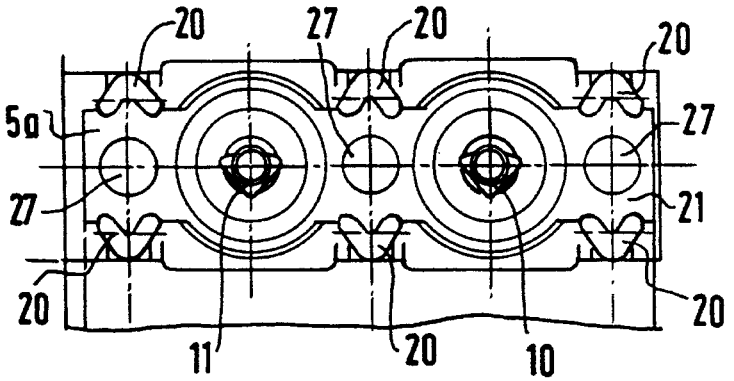
FIG. 2 is a view from below of FIG. 1.
Figure 3:
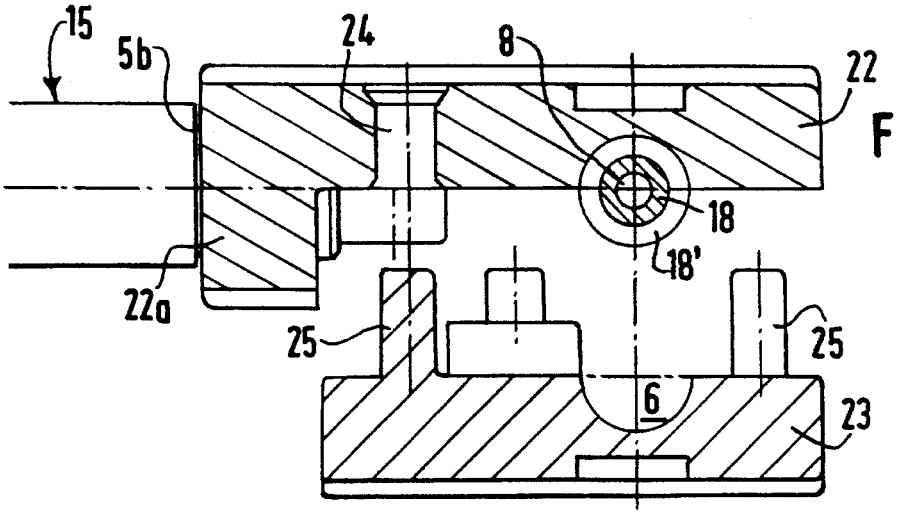
FIG. 3 is a view in section along III—III of FIG. 1.
Figure 7:
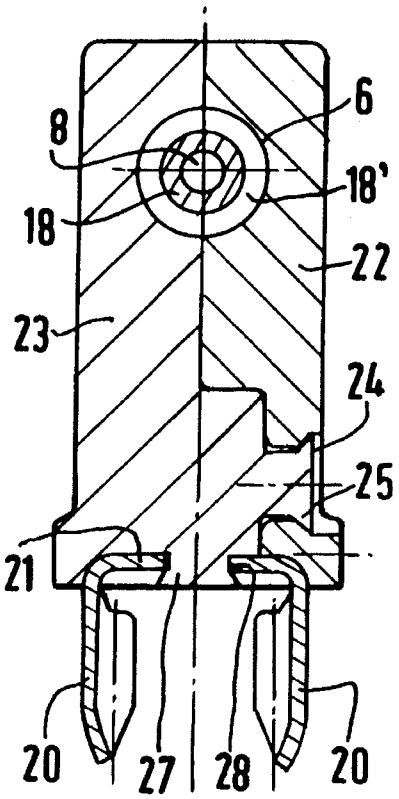
FIG. 7 is a view in section along VII—VII of FIG. 1.

The contact pins 20 each present a V-shaped cross-section, visible on the view from below of FIG. 2. Each earth contact pin 20 is a cut-out and curved-over part of a common earth plate 21, the U-shaped cross-section of which is visible in FIGS. 6 and 7.

Figure 6:
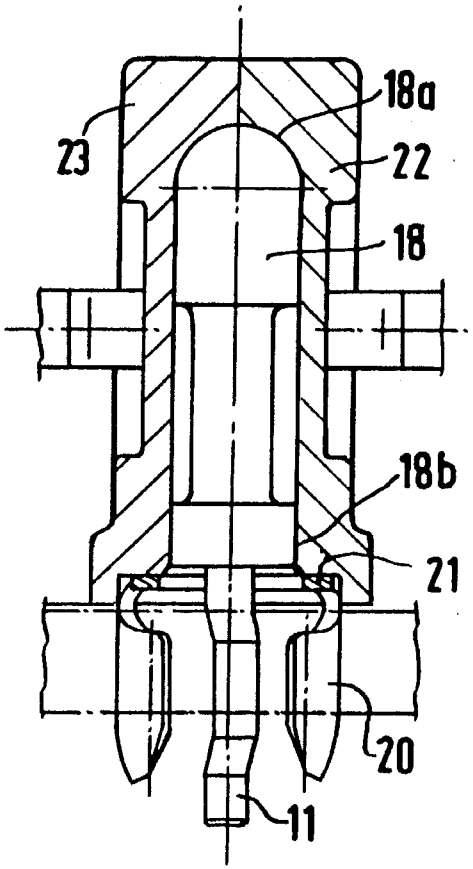
FIG. 6 is a view in partial section along VI—VI of FIG. 1.

In FIG. 6, the insulant 18 is represented filled in.

In the embodiment represented, the parallelepipedal body 5 of the angled element 1 is produced in two parts 22 and 23 which are clearly visible on the sectional views of FIGS. 3 to 7.

In the assembled state of the body 5, the parts 22 and 23 are assembled essentially in the region of the plane containing the axes of the two L-shaped conduits 6 and 7.

The part 22 extends over the whole length of the parallelepipedal body 5 and includes, on the front face 5*b*side of the said body, a turned-back part 22*a* to which the coaxial contacts 14 and 15 are fixed.

The parts 22, 23 each include two semi-cylindrical grooves angled on their opposing faces, these two grooves constituting the L-shaped conduits 6 and 7 of the parallelepipedal body 5, when the two parts 22, 23 are united.

Figure 5:
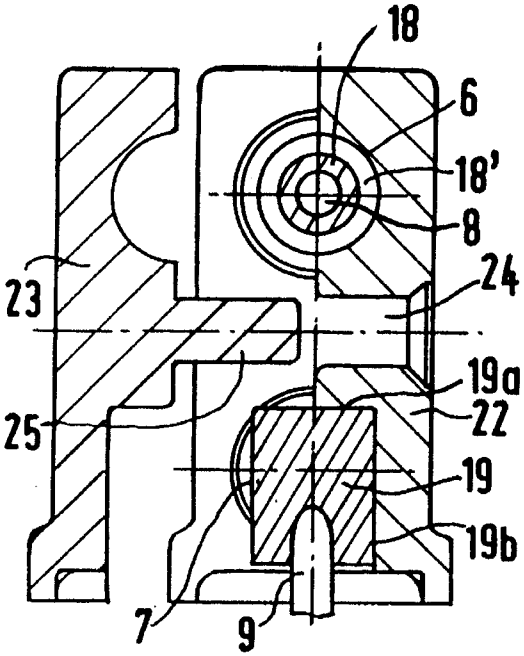
FIG. 5 is a view in section along V—V of FIG. 1.

It is seen clearly, especially in FIGS. 5 and 6, that the cross-section of the insulants 18 and 19 coincides with that of the conduits 6 and 7 in the region of the angled parts of the conducting stalks 8 and 9.

Assembly of the angled element 1 takes place in the following way.

First of all the angled conducting stalks 8 and 9, overmoulded with their insulants 18 and 19, are placed in the corresponding grooves of the parts 22 and 23.

These parts are then assembled together.

To this end, the part 22 includes four orifices 24, flared outwards, into which the studs 25 integral with the part 23 penetrate.

After assembling the two parts 22 and 23, each stud 25 is riveted, its extremity thus flattened being retained in the flared throat of the orifice 24.

The outer sleeves of the coaxial contacts 14 and 15 are then inserted by force into the orifices 26 provided for this purpose on the face 5*b* of the part 22.

Figure 4:
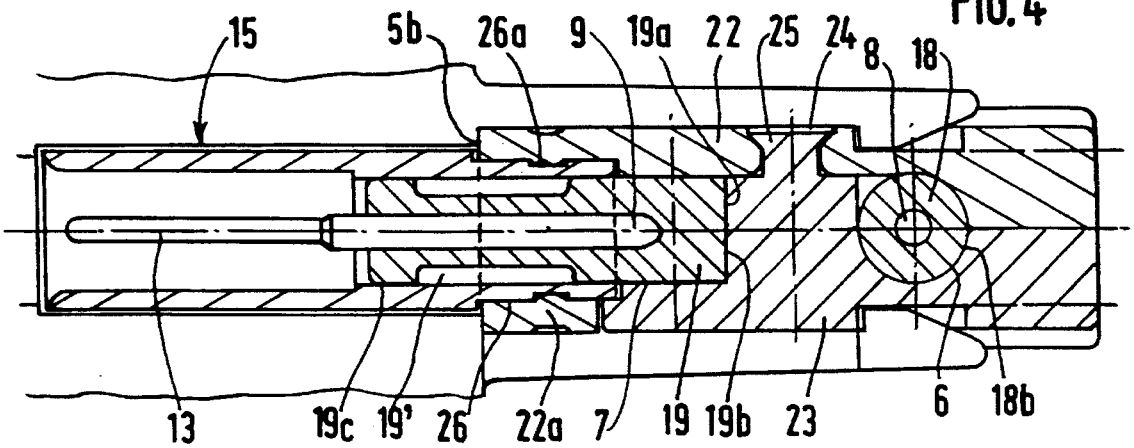
FIG. 4 is a view in section along IV—IV of FIG. 1.

For security, these sleeves are held in position by crimping the part 22 around a groove 26*a* provided on each sleeve, as is clearly seen in FIG. 4.

Finally, the earth plate 21 is fixed by riveting to the lower face 5*a* of the body 5, which includes studs 27 penetrating into orifices 28 of the plate 21.

In this way, an angled coaxial connector element is produced in a particularly simple way, a connector element which is capable of including contacts which can be inserted by force as pins for connecting to a printed card.

It is clearly understood that the embodiment which has just been described presents no limiting character and that it could accommodate any desirable modifications without departing, for that reason, from the scope of the invention.

We claim:

1. An angled coaxial connector element including:

(a) a substantially parallelepipedal conductor body having a first and a second face perpendicular to each other and at least two L-shaped conduits, each having an inner wall and an opening on said first and second faces of the body, (b) each L-shaped conduit having two axes contained in a common plane, (c) the body being produced in two separate body parts assembled along said plane, (d) pins projecting from the first face of the body for connecting the connector element to a printed circuit board, (e) at least two coaxial contacts, each located at the opening of the L-shaped conduits on the second face of the body, (f) each coaxial contact comprising a central conductor and an external conductor, the external conductor of each coaxial contact being electrically connected to the body, (g) at least two conducting stalks having a bend between two straight branches making said stalks angled, each angled stalk located in said L-shaped conduit and having a first end portion connected to the central conductor of a coaxial contact of the second face of the body, and (h) an insulant surrounding each angled conducting stalk and having an external surface bearing against the inner wall of the L-shaped conduit at least in the region of the bend in which the stalk is located.

2. The angled coaxial connector element of claim 1, in which (a) said insulant surrounding each angled conducting stalk is of substantially constant width in the region of the bend of said stalk.

3. The angled coaxial connector element of claim 1, in which (a) each of said stalks has said insulant overmolded thereon.

4. An angled coaxial connector element according to claim 1, characterized in that the two body parts are held by riveting studs integral with one of said two body parts, within orifices produced in the other of said two parts.

5. An angled coaxial connector element according to claim 5, characterized in that it includes an earth plate riveted to both of said two parts of the conductor body.

6. An angled coaxial connector element according to claim 1, characterized in that the insulant has a narrowing in cross-section defining a layer of air around at least a part of the straight branch of said angled stalk.

* * * * *